US005974292A

United States Patent [19]

Domoto et al.

[11] Patent Number: 5,974,292

[45] Date of Patent: Oct. 26, 1999

[54] LIQUID INK DEVELOPMENT DRAGOUT CONTROL

[75] Inventors: Gerald A. Domoto, Briarcliff Manor; Fong-Jen J. Wang, Pittsford; Oscar G. Hauser, Rochester, all of N.Y.

[73] Assignee: Xerox Corporation, Stamford, Conn.

[21] Appl. No.: 09/141,449

[22] Filed: Aug. 27, 1998

Related U.S. Application Data

[60] Provisional application No. 60/063,902, Oct. 31, 1997.

[51] Int. Cl.[6] ..... G03G 15/11

[52] U.S. Cl. ..... 399/249; 399/237; 399/296; 430/117

[58] Field of Search ..... 399/249, 250, 399/237, 239, 240, 296, 241, 242; 430/97, 117

[56] References Cited

U.S. PATENT DOCUMENTS

| | | | |
|---|---|---|---|
| 4,566,781 | 1/1986 | Kuehnle | 399/240 |
| 4,686,936 | 8/1987 | Chow | 399/239 |
| 5,028,964 | 7/1991 | Landa et al. | 399/390 |
| 5,255,058 | 10/1993 | Pinhas et al. | 399/348 |
| 5,409,557 | 4/1995 | Mammino et al. | 156/137 |
| 5,424,813 | 6/1995 | Schlueter et al. | 399/239 |
| 5,559,588 | 9/1996 | Larson et al. | 399/240 |
| 5,655,192 | 8/1997 | Denton et al. | 399/240 |
| 5,708,937 | 1/1998 | Lestrange et al. | 399/239 |
| 5,758,237 | 5/1998 | Abramsohn | 399/249 |
| 5,815,779 | 9/1998 | Abramsohn | 399/249 |
| 5,835,826 | 11/1998 | Okada et al. | 399/249 |

FOREIGN PATENT DOCUMENTS 8-044120 2/1996 Japan .

OTHER PUBLICATIONS

U.S. Provisional Patent Application 60/063937, filed Oct. 31, 1997, now patent application 09/092,512, filed Jun. 5, 1998, entitled "Liquid Immersion Development Machine Having a Multiple Zone Image Development and Conditioning Apparatus."

*Primary Examiner*—William Royer
*Assistant Examiner*—Sophia S. Chen

[57] ABSTRACT

The undesirable image defect of dragout of liquid ink development (LID) toned images generated from the development zone, formed by an imaging member and a metering/development member, can be prevented. Background development of the toned images is suppressed in an image enhancement zone. With the aid of an enhanced electrostatic field, created by an electrode biased at a voltage other than normal development bias in the metering zone, the toned layer can resist higher viscous forces. Image dragout, due to the viscous shear from liquid ink, can therefore be eliminated.

17 Claims, 5 Drawing Sheets

LIQUID INK DEVELOPMENT DRAGOUT CONTROL

This application claims benefit of Provisional Appln. 60/063,902 filed Oct. 31, 1997.

This invention relates generally to a method and apparatus for liquid ink development and more particularly concerns using an electrostatic field to stabilize the developed liquid ink image.

Currently, developing liquid ink development (LID) images is accomplished by using a reverse and/or biased metering roll and a photoreceptor roll or belt to form the development zone. Ink is introduced into this zone to develop the image while moving the metering roll against the photoreceptor. Among other advantages, the metering roll provides a robust mechanism to remove the excess carrier fluid, which assists in achieving both background free development and higher solids content of the toned images. A major drawback, however is the image dragout caused by the viscous shear due to the relative motion of the metering roll and the photoreceptor. Dragout is an image defect often seen as a smear in the trailing edge of a toned image.

Current approaches to preventing dragout are by manipulation of the ink materials. However, as speed and viscosity are increased, the requirements of high mobility and high cohesiveness as well as the ability to transfer and transfuse and image condition places many requirements on the ink.

U.S. Pat. No. 5,255,058 discloses a liquid developer imaging system using a spaced developing roller and a background cleaning station and an electrified squeegee to compact the developed image. The background cleaning station and electrified squeegee are at two different biases and are placed some distance apart in the imaging system.

U.S. Pat. No. 5,028,964 discloses a liquid ink imaging system having a biased metering roller that removes background toner and reduces the thickness of the liquid image on the photoreceptor. An optionally charged rigidizing roller then compresses and rigidizes the image.

U.S. Pat. No. 5,559,588 teaches a LID system capable of producing clean background and stabilized liquid toner images. This is accomplished by using a liquid toner developer material with a liquid carrier having a relatively low conductivity and charged toner particles dispersed within the carrier that have a relatively high charge level for making the toner particles more sensitive to a low voltage image conditioning electric field. An image stabilization roller has a relatively low voltage biasing field for image conditioning to achieve effective image stabilization as well as clean developed image background areas.

U.S. Pat. No. 5,655,192 teaches compaction of a liquid ink developed image which uses a biased electrode situated proximate to the image on an image bearing surface and a liquid applicator for depositing liquid insulating material in a conditioning gap defined by the electrode and the image bearing surface, A high electric potential is applied to the electrode for generating a large electric field in the gap to electrostatically compress toner particles into image areas on the image bearing surface.

U.S. Provisional Patent Application No. 60/063,937 entitled "Liquid Immersion Development Machine Having a Multiple Zone Image Development and Conditioning Apparatus", filed on Oct. 31, 1997, now U.S. patent application Ser. No. 09/092,512 filed on Jun. 5, 1998, and assigned to the same assignee as the present application, teaches a single multiple zone image development and conditioning system. The first zone has a first biased electrode for partially removing charged solid toner particles from background areas, the second zone has a second biased electrode which completes the removal of charged solid toner particles, and the third zone has a third biased electrode for compacting the developed image.

All of the above references are hereby incorporated by reference.

SUMMARY OF THE INVENTION

One aspect of the invention is drawn to an apparatus for enhancing liquid ink development having an imaging member with a latent image formed thereon, an ink application member which applies liquid ink to the imaging member to develop the latent image and a metering/development member spaced from the ink application member which removes excess liquid ink from the imaging member applied by the ink application member. A metering nip is formed between the metering/development member and the imaging member, with an air/ink interface initially formed near the metering nip. A first electrical bias source supplies a first electric field between the metering/development member and the imaging member to assist in suppressing background development on the imaging member in an image enhancement zone and a second electrical bias source supplies a second electric field between the metering/development member and the imaging member to assist in compacting the developed image on the imaging member in a metering zone in the vicinity of the metering nip.

Another aspect of the present invention is drawn to a method for enhancing liquid ink development in which liquid ink is applied with an ink application member to the imaging member which develops a latent image formed thereon. Excess liquid ink is metered from the imaging member with a metering/development member spaced a distance from the ink application member, a metering nip being formed between the metering/development member and the imaging member, with an air/image interface initially formed near the metering nip. A first electrical bias is applied to create a first electric field between the metering/development member and the imaging member to assist in suppressing background development on the imaging member in an image enhancement zone. An optional second electrical bias is applied to create a second electric field between the metering/development member and the imaging member to assist in suppressing background development on the imaging member in the image enhancement zone. A final electrical bias is applied to create a final electric field between the metering/development member and the imaging member to assist in compacting the developed image on the imaging member in a metering zone.

The undesirable image defect of dragout of liquid ink development (LID) toned images generated from the development zone, formed by an imaging member and a reverse metering member, can be prevented. With the aid of an enhanced electrostatic field, created by an electrode biased at a voltage other than normal development bias, the toned layer can resist higher viscous forces. Image dragout, due to the viscous shear from liquid ink, can therefore be eliminated.

DETAILED DESCRIPTION OF THE INVENTION

Figure 1:
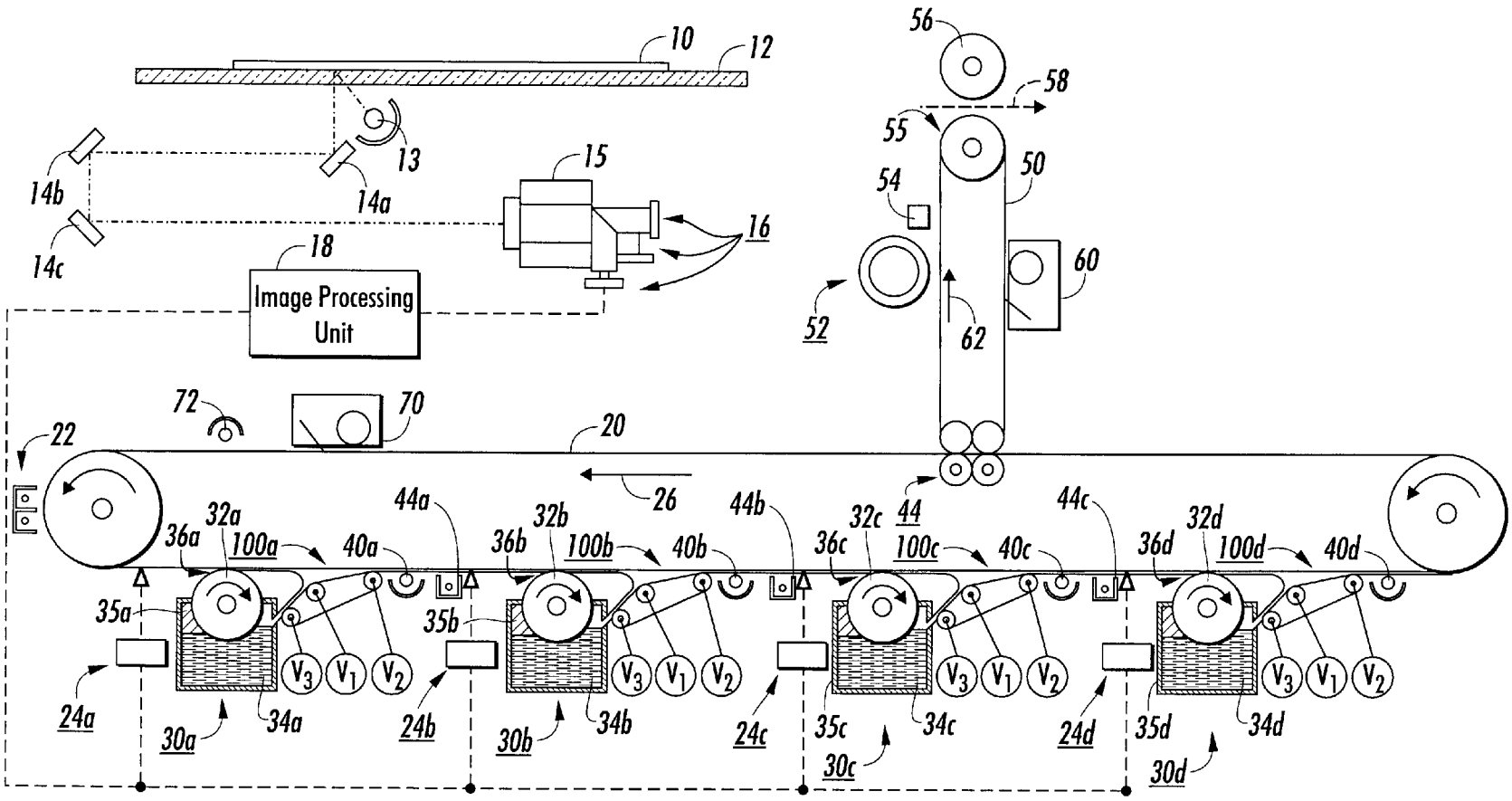
FIG. 1 shows a schematic view of an electrophotographic machine with the image enhancement assembly of the present invention.

For a general understanding of the features of the present invention, reference numerals have been used throughout to designate identical elements. FIG. 1 schematically depicts the various elements of an illustrative color electrophotographic printing machine incorporating the present invention therein. It will become evident from the following discussion that the present invention is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, there is shown a color document imaging system incorporating the present invention. The color copy process can begin by either inputting a computer generated color image into the image processing unit 18 or by way of example, placing a color document 10 to be copied on the surface of a transparent platen 12. A scanning assembly consisting of a halogen or tungsten lamp 13 which is used as a light source, and the light from it is exposed onto the color document 10; the light reflected from the color document 10 is reflected by the 1st, 2nd, and 3rd mirrors 14*a*, 14*b* and 14*c*, respectively, then the light passes through lenses (not shown) and a dichroic prism 15 to three charged-coupled devices (CCDs) 16 where the information is read. The reflected light is separated into the three primary colors by the dichroic prism 15 and the CCDs 16. Each CCD 16 outputs an analog voltage which is proportional to the intensity of the incident light. The analog signal from each CCD 16 is converted into an 8-bit digital signal for each pixel (picture element) by an analog/digital converter. The digital signal enters an image processing unit 18. The digital signals which represent the blue, green, and red density signals are converted in the image processing unit into four bitmaps: yellow (Y), cyan (C), magenta (M), and black (B). The bitmap represents the value of exposure for each pixel, the color components as well as the color separation. Image processing unit 18 may contain a shading correction unit, an undercolor removal unit (UCR), a masking unit, a dithering unit, a gray level processing unit, and other imaging processing sub-systems known in the art. The image processing unit 18 can store bitmap information for subsequent images or can operate in a real time mode.

The image member 20, preferably a belt of the type which is typically multi-layered and has a substrate, a conductive layer, an optional adhesive layer, an optional hole blocking layer, a charge generating layer, a charge transport layer, and, in some embodiments, an anti-curl backing layer travels in the direction of arrow 26. It is preferred that the imaging member employed in the present invention be infrared sensitive this allows improved transmittance through a previously developed cyan image. Image belt 20 is charged by charging unit 22. Raster output scanner (ROS) 24*a*, controlled by image processing unit 18, writes a first complementary color image bitmap information by selectively erasing charges on the image belt 20. The ROS 24*a* writes the image information pixel by pixel in a line screen registration mode. It should be noted that either discharged area development (DAD) can be employed in which discharged portions are developed or charged area development (CAD) can be employed in which the charged portions are developed with toner.

After the electrostatic latent image has been recorded, image belt 20 advances the electrostatic latent image to ink application station 30*a*. Like subsequent ink application stations apparatus 30*b*, 30*c* and 30*d*, ink application station 30*a* includes a housing 35*a*, containing liquid developer material 34*a*, and a rotatable ink applicator 32*a*. A multiple zone image enhancement assembly 100*a* of the present invention further develops and meters the developed image on image belt 20. Rotatable applicator 32*a* rotates in the direction of the arrow shown, advancing liquid developer material 34*a* from the chamber of housing 35*a* to image coating nip 36*a*. The toner particles, disseminated through the liquid carrier, pass by electrophoresis to the electrostatic latent image, thus beginning the development process. Then the coated image passes to image enhancement assembly 100*a* which is where the development and metering processes are completed.

The liquid developers suitable for the present invention generally comprise a liquid vehicle, toner particles, and a charge control additive. The liquid medium may be any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. Generally, the liquid medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved.

The toner particles can be any colored particle compatible with the liquid medium, such as those contained in the developers disclosed, for example, in U.S. Pat. Nos. 3,729,419; 3,841,893; 3,968,044; 4,476,210; 4,707,429; 4,762,764; and 4,794,651; and U.S. patent application Ser. No. 08/268,608, now U.S. Pat. No. 5,451,48 the disclosures of each of which are totally incorporated herein by reference. The toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Other examples of suitable resins are disclosed in U.S. Pat. No. 4,476,210, the disclosure of which is totally incorporated herein by reference. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, all available from Sandoz Company, Mississauga, Ontario, and the like. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it combines well with any polymeric material also included in the developer composition. Pigment particles are generally present in amounts of from about 5 to about 40 percent by weight of the toner particles, and preferably from about 10 to about 30 percent by weight. The toner particles should have an average particle diameter from about 0.2 to about 10 microns, and preferably from about 0.5 to about 2 microns. The toner particles may be present in amounts of from about 1 to about 10, and preferably from about 2 to about 4 percent by weight of the developer composition.

Examples of suitable charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like. The charge control additive may be present in an amount of from about 0.01 to about 3 percent by weight, and preferably from about 0.02 to about 0.05 percent by weight of the developer composition.

After the electrostatic image is coated, it passes to multiple zone image enhancement assembly 100*a*, which completes development and enhances the image by reducing fluid content while inhibiting the departure of toner particles from the developed image. The operation of enhancement station 100*a* will be described in more detail with reference to FIG. 3. After enhancement assembly 100*a*, the developed image on image belt 20 advances to lamp 40*a* where any residual charge left on the photoconductive surface is extinguished by flooding the photoconductive surface with light from lamp 40*a*.

The development takes place for the second color for example magenta, as follows: the developed latent image on image belt 20 is recharged with charging unit 44*a*. The developed image is re-exposed by ROS 24*b*, ROS 24*b* superimposing a second color image bitmap information over the previously developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other, as described in U.S. Pat. No. 5,477317 the relevant portions of which are hereby incorporated by reference herein. At ink application station 30*b*, ink applicator 32*b*, rotating in the direction of the arrow shown, advances a liquid developer material 34*b* from the chamber of housing 35*b* to ink application nip 36*b*. The toner particles, disseminated through the liquid carrier, pass by electrophoresis to the second electrostatic image. Multiple zone image enhancement assembly 100*b* receives the developed image on image belt 20 and conditions the image by reducing fluid content while inhibiting the departure of toner particles from the developed image. The image on image belt 20 advances to lamps 40*b* where any residual charge left on the photoconductive surface is extinguished by flooding the photoconductive surface with light from lamp 40*b*.

The development takes place for the third color for example cyan as follows: the developed latent image on image belt 20 is recharged with charging unit 44*b*. The developed latent image is re-exposed by ROS 24*c*, ROS 24*c* superimposing a third color image bitmap information over the previously developed images. At ink application station 30*c*, image coating assembly 32*c*, rotating in the direction of the arrows shown, advances a liquid developer material 34*c* from the chamber of housing 35*c* to image coating zone 36*c*. The toner particles, disseminated through the liquid carrier, pass by electrophoresis to the third electrostatic image. Multiple zone image enhancement assembly 100*c* receives the developed image on image belt 20 and conditions the image by reducing fluid content. The image on image belt 20 advances to lamps 40*c* where any residual charge left on the photoconductive surface is extinguished by flooding the photoconductive surface with light from lamp 40*c*.

The development takes place for the fourth color, for example black, as follows: the developed latent image on image belt 20 is recharged with charging unit 44*c*. The developed image is re-exposed by ROS 24*d*, which superimposes a fourth color image bitmap information over the previously developed latent image. At ink application station 30*d*, image coating assembly 32*d*, rotating in the direction of the arrow as shown, advances liquid developer material 34*d* from the chamber of housing 35*d* to image coating zone 36*d*. The toner particles, disseminated through the liquid carrier, pass by electrophoresis to the fourth electrostatic image. Multiple zone image enhancement assembly 100*d* receives the developed image on image belt 20 and conditions the image by reducing fluid content to a desired amount. The image on image belt 20 advances to lamps 40*d* where any residual charge left on the photoconductive surface is extinguished by flooding the photoconductive surface with light from lamp 40*d*.

The resultant image, a multi-layer image by virtue of the ink application stations 30*a*, 30*b*, 30*c* and 30*d* having yellow, magenta, cyan and black toner disposed therein advances to an intermediate transfer station. It should be evident to one skilled in the art that the color of toner at each ink application station could be in a different arrangement. At the intermediate transfer station, the resultant image is electrostatically transferred to intermediate member 50 by belt transfer rollers 44.

Intermediate belt 50 travels in the direction of arrow 62 and provides the opportunity for further image conditioning, which can be done by blotting roller 52 or heat assisted evaporation. The further conditioned image is therefore more suitable for transfuse 55. Subsequently, multi-layer image, present on the surface of the intermediate member passes heating element 54, which not only heats the external wall of the intermediate member in the region of transfix nip 55, but because of the mass and thermal conductivity of the intermediate member, generally maintains the outer wall of member 50 at a temperature sufficient to cause the toner particles present on the surface to melt and stay tacky until the image passes through the transfix nip. At transfix nip 55, backup pressure roller 56 contacts the surface of recording sheet 58. After the developed image is transferred to recording sheet 58, intermediate member 50 is cleaned and cooled at intermediate member cleaning station 60.

After image belt 20 passes the transfer station, residual liquid developer material remaining on the belt is removed at belt cleaning station 70. Any number of photoconductor cleaning means exist in the art, any of which would be suitable for use. Any residual charge left on the photoconductive surface is extinguished by flooding the photoconductive surface with light from lamp 72. An electronic control subsystem controls various components and operating subsystems of the reproduction machine. The control subsystem handles control data including control signals from control sensors for the various controllable aspects of the machine.

Figure 2:
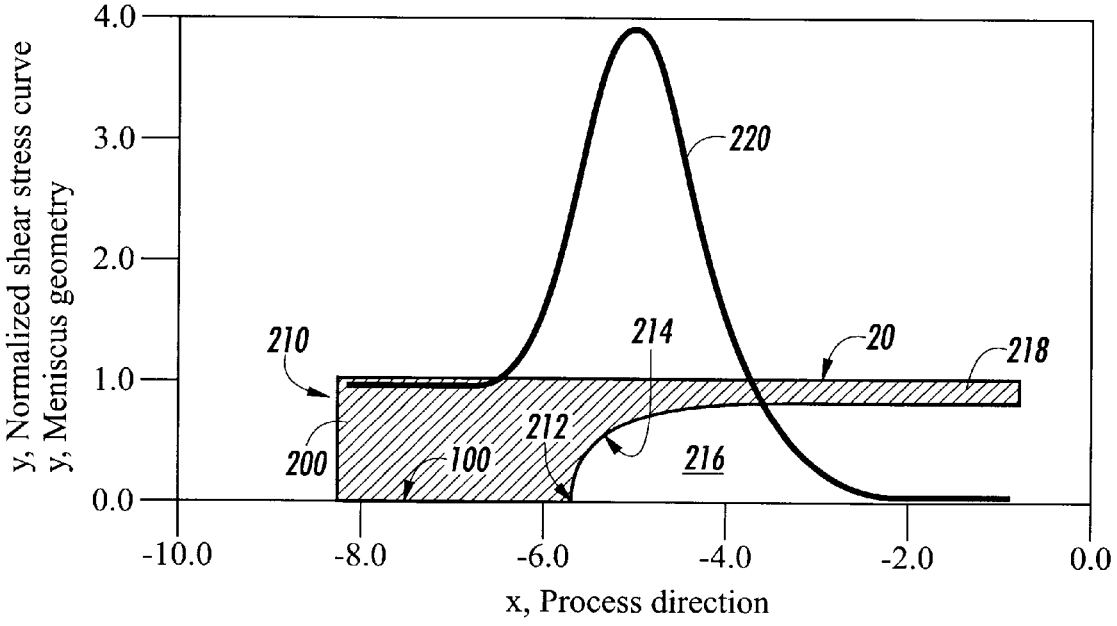
FIG. 2 shows shear stress in the process direction of the liquid ink on the developed image in the metering zone.

FIG. 2 shows why dragout occurs at the trailing edge of toned images due to hydrodynamic stresses between an imaging member and metering member. The calculated results shown in FIG. 2 were obtained using an imaging member in the form of an imaging roll with a 9.5 inch diameter, and metering member in the form of a metering roll with a 6 inch diameter, with a minimum gap between the imaging roll and metering roll being 0.003 inches. The process speed of imaging member being 20 inches/second and the metering speed was also 20 inches/second. The carrier fluid used for ink 200 was NORPAR 15.

The shear stress distribution is plotted versus process direction, x. The stress value 220 is normalized by the stress within the development zone (i.e., at x=−8.0). The corresponding geometry 210 of the liquid layer 200 is also calculated and displayed in FIG. 2, with contact point 212 being where ink 200 contacts metering member and forms ink/air meniscus 214 with air layer 216 and metered image 218. As depicted by calculated geometry 210, soon after contact point 212, metered image 218 is formed on the imaging member with a uniform thickness, thinner than the minimum gap between the two rolls.

The maximum shear stress within the developer fluid does not occur in the zone where the ink fully occupies the gap, it appears rather down stream of contact point 212 where the liquid ink 200 quickly converges into a thin ink layer on imaging member. In this region the presence of air layer 216 also reduces the electrostatic field normal to the toned layer surface. It is in this area that the developed toner layer is most vulnerable to the shear force 220 as shown in FIG. 2. If the toner is sheared off from the toned layer in this region, it can go nowhere but follow the fluid streamlines which basically move with the imaging member to form the final damaged toned image layer. The field controlling background development can no longer draw the loose, sheared off toner to the metering roll surface because of air/ink interface 214. Thus, the loose toner must continue out of the development zone with the imaging member. There is strong evidence that the visible image dragout happens at the end of the development zone where the shear stress is highest, shown by 220 in FIG. 2.

Assuming background free development is achieved prior to contact point 212, it is safe to apply an enhanced field of such polarity as to tack the image to the photoreceptor. The field provides an extra electrostatic force, which compacts the toned image and causes it to resist shear thus preventing dragout of the developed image.

Figure 3:
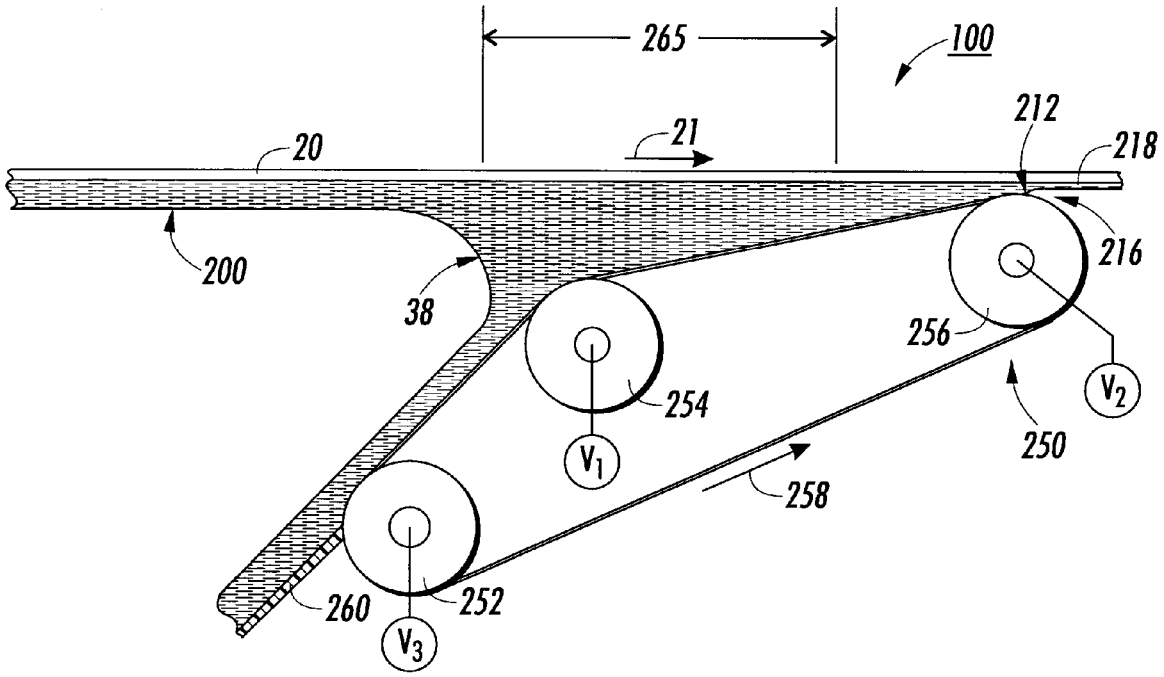
FIG. 3 shows a first embodiment of the image enhancement assembly.

FIG. 3 shows the details of the embodiment of the image enhancement assembly 100 depicted in FIG. 1. Imaging member 20 travels in the direction indicated by arrow 21 and brings ink 200 to image enhancement zone 265. Air/ink meniscus 38 is formed at the beginning of enhancement zone 265. Metering/development belt 250 is supported by rolls 252, 254 and 256 and travels in the direction indicated by arrow 258, being driven by drive roll 252. Cleaning blade 260 removes the liquid ink waste from metering/development belt 250, as the etering/development belt moves past it. Belt 250 is a semi-conductive belt and rolls 254 and 256 are electrically biased rolls. Metering/development belt 250 is selected so that it will not draw much current laterally and is able to maintain a several hundred-volt difference between the two rolls. Roll 254 is biased so development and background cleaning can take place while roll 256 is the effective metering roll. In a preferred embodiment, the distance between roll 254 and imaging member 20 is about 10 mils and the distance between roll 256 and imaging member 20 is kept at about 2–4 mils.

In the embodiment shown in FIG. 3, $V_1$, $V_2$ and $V_3$ are such that background suppression and development completion occurs between 254 and 256. Then as the imaging member moves from roll 254 toward roll 256, the fluid is clear in both the background regions and the image areas since the background toner has been swept away by the motion of the fluid next to the moving, semi-conductive belt. However, the laterally semi-conductive belt is a voltage divider so that the electric field perpendicular to the imaging member increases as the imaging member moves from roll 254 toward roll 256. This happens because the voltage along the belt is a function of position along the belt between roll 254 and roll 256.

Figure 4:
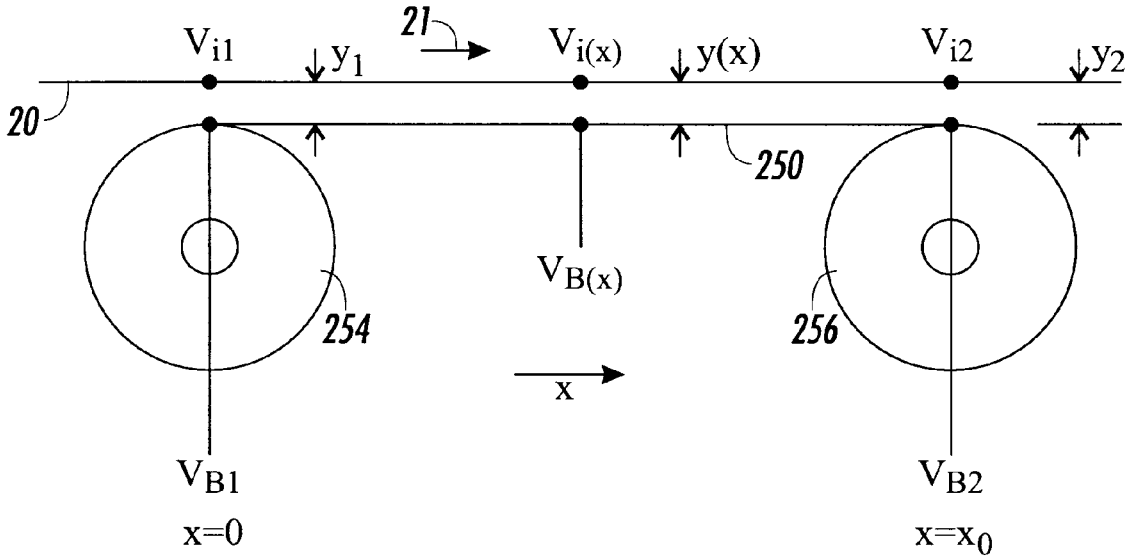
FIG. 4 shows the applied voltages and distance measurements for the example encompassing the first embodiment.

For example, in a linear system, as shown in FIG. 4, $$V_{B(x)}=V_{B1}-(V_{B1}-V_{B2})x/x_0$$

$$\Delta V_{neut(X)}=V_{P/R}-V_{i(x)}$$

where $V_{B1}$ is the belt voltage at roll 254

$V_{B2}$ is the belt voltage at roll 256

$V_{B(X)}$ is the belt voltage at position x $x_0$ is the distance x at roll 256

$\Delta V_{neut(x)}$ is a function of development parameters and distance x $V_{P/R}$ is the image potential before development on incoming image member $V_{i(x)}$ is the image potential at position x between rolls 254 and 256

Also, $$y(x)=y_1-(y_1-y_2)x/x_0$$

$$E(x)=(V_{i(X)}-V_{B(X)}/y(x)$$

where y(x) and E(x) are the distance between the two belt surfaces and development field at position x respectively Thus using DAD, suppose in background areas $V_{P/R}$=−600V and $V_{B1}$=−300V and in image areas $V_{P/R}$=−50V and $\Delta V_{neut(x=x0/2)}$=−200V. In this case $V_{neut}$ is halfway between roll 254 and roll 256 the image is neutralized. Then if $V_{B2}$=−300V and $y_1=y_2$, then $E(x=x_0/2)=(-250V-(-300v))/y_1=50/y_1$ V/micron. In the background area, no further development can occur after $x=x_0/2$ because no toner is available. But if $V_{B1}$=−300V and $V_{B2}$=−500V then if $y_1=Y_2$then the field compacting the toner image at roll 254 is $100/y_2$ V/micron. When $y_2=½y_1$, then E at roll 254 is $200/y_2$ V/micron.

Figure 5:
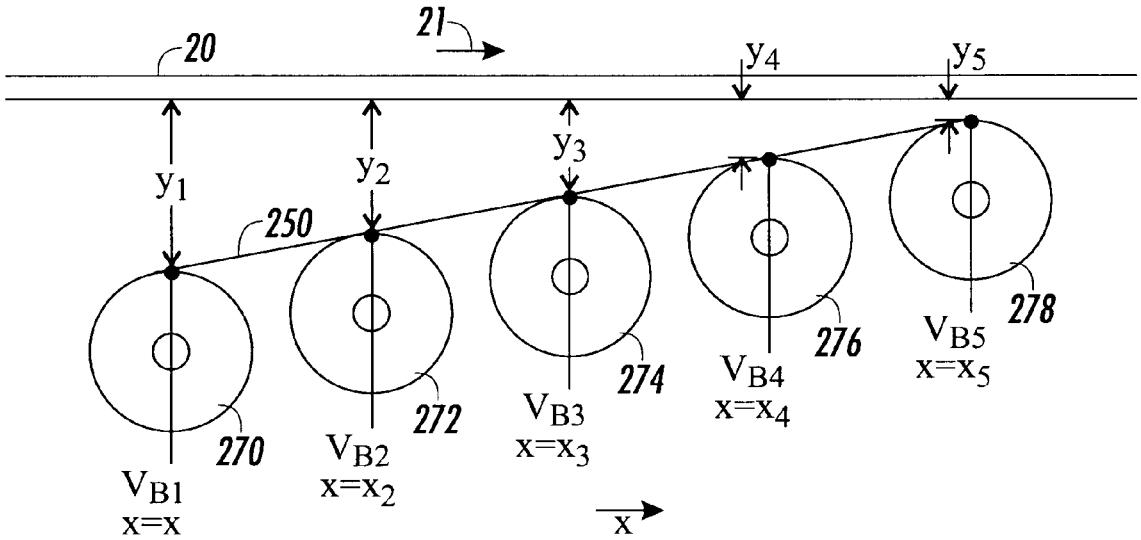
FIG. 5 shows a second embodiment of the image enhancement assembly.

In another embodiment as shown in FIG. 5, a series of voltages between a dielectric belt 250' and imaging member 20 can be established by providing a series of rollers or electrodes 270, 272, 274, 276, 278, each with its own voltage source (not shown) so that the image moves from the beginning of the development zone to the end of the development zone encountering ever increasing fields. Thus, whereas with a semiconductive belt the electric field across the toned image increases in a continuous fashion, with a series of electrodes the field increases in a stepwise fashion. The same image compaction can be achieved either way because the field across the toned image is tailored.

If image development and background suppression occur by $x=x_3$ then $V_{B4}$ and $V_{B5}$ can be adjusted to drive toner toward the photoreceptor and compact the already developed image. However, with a dielectric belt the cleaning blade also has to remove any charge accumulated on the surface of the dielectric because of development. There are several schemes available to do this, such as high frequency AC bias on the blade, or an AC biased conductive cleaning roller or some other charge neutralization device.

It is clear that as long as the belt is driven by a drive roller then electrodes 1–5 may be stationary electrodes such as shoes with applied biases. Preferably, cleaning blade (not shown) is applied to the drive roller. The advantages of stationary electrodes are that they are cheaper, easier to fabricate and are easier to space precisely than are moving members.

While the invention has been described in conjunction with specific embodiments, it is evident to those skilled in the art that many alternatives, modifications, and variations will be apparent in light of the foregoing description. Accordingly, the invention is intended to embrace all such alternatives, modifications, and variations that fall within the spirit and scope of the appended claims.

We claim:

1. An apparatus for enhancing liquid ink development comprising:

an imaging member with a latent image formed thereon;

an ink application member which applies liquid ink to the imaging member to develop the latent image;

a metering/development device spaced from the ink application member which removes excess liquid ink from the imaging member applied by the ink application member;

a metering nip formed between the metering/development device and the imaging member, with an air/link interface initially formed near the metering nip;

a first electrical bias source which supplies a first electric field between the metering/development device and the imaging member to assist in suppressing background development on the imaging member in an image enhancement zone; and a second electrical bias source which supplies a second electric field between the metering/development device and the imaging member to assist in compacting the developed image on the imaging member in a metering zone in the vicinity of the metering nip, wherein the metering/development device is a metering/development belt supported by a first roller and a second roller, the first roller being connected to the first electrical bias source and the second roller being connected to the second electrical bias source.

2. The apparatus as claimed in claim 1, wherein the first electrical bias is less than the second electrical bias.

3. The apparatus as claimed in claim 1, further comprising:

a third roller which is a drive roller for moving the metering/development belt and which supports the metering/development belt along with the first and second rollers.

4. The apparatus as claimed in claim 3, further comprising:

a third electrical bias source which supplies a third electric field between the metering/development device and the imaging member to assist in suppressing background development on the imaging member in the image enhancement zone.

5. The apparatus as claimed in claim 1, wherein the metering nip is formed by the second roller.

6. The apparatus as claimed in claim 1, wherein the first roller spaces the metering/development belt from the imaging member from between about 0.002 inches to about 0.040 inches and the second roller spaces the metering/development belt from the imaging member from between about 0.0012 inches to about 0.010 inches.

7. The apparatus as claimed in claim 1, wherein the metering/development belt is a semiconductive belt.

8. A method for enhancing liquid ink development, comprising:

forming a latent image on an imaging member;

applying liquid ink with an ink application member to the imaging member which develops the latent image;

metering excess liquid ink from the imaging member with a metering/development device spaced a distance from the ink application member, a metering nip being formed between the metering/development device and the imaging member, with an air/image interface initially formed near the metering nip;

applying a first electrical bias to create a first electric field between the metering/development device and the imaging member to assist in suppressing background development on the imaging member in an image enhancement zone; and applying a second electrical bias to create a second electric field between the metering/development device and the imaging member to assist in compacting the developed image on the imaging member in a metering zone, wherein applying the first electrical bias is less than applying the second electrical bias.

9. The method as claimed in claim 8, wherein metering includes supporting metering/development device with a first roller and a second roller.

10. The method as claimed in claim 8, wherein metering includes supporting the metering/development device with a first roller in the image enhancement zone, a second roller in the metering zone and a third roller which is a drive roller.

11. The method as claimed in claim 10, further comprising:

applying a third electrical bias to create a third electric field between the metering/development device and the imaging member to assist in suppressing background development on the imaging member in the image enhancement zone.

12. The method as claimed in claim 8, wherein metering includes supporting the metering/development device with a first non-rotatable member in the image enhancement zone, and a second non-rotatable member in the metering zone.

13. The method as claimed in claim 12, wherein metering includes supporting the metering/development device with at least a third non-rotatable member.

14. The method as claimed in claim 12, further comprising:

applying a third electrical bias to create a third electric field between the metering/development device and the imaging member to assist in suppressing background development on the imaging member in the image enhancement zone.

15. An apparatus for enhancing liquid ink development comprising:

an imaging member with a latent image formed thereon;

an ink application member which applies liquid ink to the imaging member to develop the latent image;

a metering/development device spaced from the ink application member which removes excess liquid ink from the imaging member applied by the ink application member;

a metering nip formed between the metering/development device and the imaging member, with an air/ink interface initially formed near the metering nip;

a first electrical bias source which supplies a first electric field between the metering/development device and the imaging member to assist in suppressing background development on the imaging member in an image enhancement zone; and a second electrical bias source which supplies a second electric field between the metering/development device and the imaging member to assist in compacting the developed image on the imaging member in a metering zone in the vicinity of the metering nip, wherein the metering/development device is a metering/development belt and the first electrical bias source is connected to a first fixed member and the second electrical bias source is connected to a second fixed member, the first and second fixed members non-rotatably supporting the metering/development belt.

16. The apparatus as claimed in claim 15, wherein the metering/development belt is a dielectric belt.

17. The apparatus as claimed in claim 15, further comprising:

at least a third electrical bias source which supplies at least a third electric field between the metering/development device and the imaging member to assist in suppressing background development on the imaging member in the image enhancement zone.

* * * * *